United States Patent [19]

Haist

[11] Patent Number: 4,844,271

[45] Date of Patent: Jul. 4, 1989

[54] DEEP-DRAWN SCREW CAP OF ALUMINUM FOR GLASS BOTTLES UNDER INTERNAL PRESSURE

[76] Inventor: Henri Haist, Oberwiesstrasse 491, CH-8213 Neunkirch, Switzerland

[21] Appl. No.: 131,229

[22] Filed: Dec. 10, 1987

[30] Foreign Application Priority Data

Dec. 17, 1986 [DE] Fed. Rep. of Germany ..... 3642998

[51] Int. Cl.[4] ..... B65D 51/16

[52] U.S. Cl. ..... 215/307

[58] Field of Search ..... 215/327, 324, 307, 260, 215/337, 329, 341

[56] References Cited

U.S. PATENT DOCUMENTS

| | | | |
|---|---|---|---|
| 1,381,365 | 6/1921 | Taliaferro | 215/337 |
| 2,456,607 | 12/1948 | Shaffer . | |
| 4,007,848 | 2/1976 | Snyder | 215/307 X |
| 4,007,851 | 2/1977 | Walker | 215/307 |
| 4,466,548 | 8/1984 | Herbert | 215/307 |

FOREIGN PATENT DOCUMENTS

| | | |
|---|---|---|
| 2829755 | 1/1980 | Fed. Rep. of Germany . |
| 256326 | 9/1926 | United Kingdom . |

*Primary Examiner*—Donald F. Norton

*Attorney, Agent, or Firm*—Cushman, Darby & Cushman

[57] ABSTRACT

A deep-drawn screw cap of aluminum for glass bottles under internal pressure, where the transition area between the upper end face 1 to the lateral thread face 2 up to now was always evenly deep-drawn, now is to have at least one undeformed partial area 8. Because of this, sealing against the lateral edge 7 of the mouth is partially disrupted and a chance for the escape of gas is purposely provided in case the internal pressure in the glass bottle should rise too high. If required, a plurality of such partial areas 8 may be provided. In the deep-drawing device for a sealing head for the production of such screw caps the inner recess 12 should provide at least one partial enlargement 14 oriented towards the center axis 13 and extending approximately to the diameter of the preceding recess 11.

4 Claims, 3 Drawing Sheets

DEEP-DRAWN SCREW CAP OF ALUMINUM FOR GLASS BOTTLES UNDER INTERNAL PRESSURE

The invention relates to a deep-drawn screw cap of aluminum for glass bottles under internal pressure, having an upper end face, a lateral thread face and, if required, a sealing ring, a sealing material being disposed on the inside of the end face, particularly close to the transition to the thread face, by means of which a seal along the edge of the mouth of a glass bottle is attained when the closure is completely formed. The invention also relates to a deep-drawing device for a sealing head for providing such screw caps of aluminum for glass bottles under internal pressure, having a matrix with several concentric recesses continuously decreasing in size from the outside towards the inside which can be pushed onto the unfinished screw cap from above, the first recess tapering from the outside in until reaching approximately the largest outside diameter of the screw cap, followed by a second recess with a constant diameter and finally followed by a third recess with a smaller diameter which is used for deep-drawing the unfinished screw cap down to the lateral edge of the mouth of a glass bottle.

BACKGROUND OF THE INVENTION

In connection with the technology regarding glass bottles with an outer thread at the mouth, a basic distinction must be made between two types of screw caps, namely, leak-proof screw caps for liquids on the one hand, which are generally known as so-called pilfer-proof closures or PP-closures for short, and on the other hand screw caps which are air-tight, also known in the trade as GD-closures. The first type of closure is used with so-called still beverages such as, for example, spirits. In this type of closure the seal is made between the upper end face of the screw cap, which normally contains the seal, and the upper edge of the mouth of the glass bottle. By means of the active thread, i.e. the outer thread of the glass bottle, together with the thread face of the screw cap created by screwing it down, sufficient pressure can be maintained. However, because there is no air-tight closure, the system in question must be classified only as leak-proof.

Therefore such closures are unsuited for carbonated beverages. As a rule, these are bottled under a pressure of several bar, e.g. 4 to 6 bar. They require air-tight closures in which an additional seal is attained by deep-drawing of the transition area between the upper end face and the lateral thread face of the screw cap onto the lateral edge of the mouth of the glass bottle. This system can be classified as extremely tight and pressure retaining. In view of the many carbonated beverages which are bottled in this manner and also because of its basic suitability for bottling fruit juices in accordance with this system, i.e. to seal them, the technology is used, mostly without change, for reasons of efficiency (to avoid additional outlays for tools and retrofitting) in connection with fruit juices.

In any case, air-tight screw caps are obviously used in considerable numbers. Thus it is possible that troubles of grave consequence can occur—even though only occasionally. Depending on the degree to which a glass bottle containing a carbonated beverage is emptied and on the action of the outside temperature, internal pressures can easily build up which considerably exceed the internal pressure at the time of bottling. This can result in the screw cap blowing off and the glass bottle "venting". The blowing off of the screw cap can be extremely violent, even like the firing of a projectile, and therefore is very dangerous. However, this must be considered as the lesser evil. It is not always the screw cap which in such cases represents the weakest point, sometimes the glass bottle itself cannot withstand such internal pressure. This frequently leads to an explosive destruction of the glass bottle which, if people are present, can result in extremely dangerous injuries. This has been repeatedly reported in the press.

But fruit juice bottles provided with air-tight screw caps also are a source of serious danger. Normally, fruit juices are bottled while hot, which at first results in a vacuum; however, an internal pressure can also build up with fruit juices as a result of fermentation. This is all the more noteworthy, because often glass bottles with lesser wall thicknesses are chosen for fruit juices. Thus, there is also a considerable danger of injuries in these cases. Different screw caps are known, particularly in connection with fruit juices, namely those with a circular stamped area in the center of the upper end face which permits the central part thus defined to either bend downwardly as an indicator of a vacuum or, if the internal pressure is unacceptably high, to break off along the stamped line (the predetermined breaking point). However, these methods do not apply if, under standard practices—as previously stated, for reasons of cost—, carbonated beverages and fruit juices are being treated in the same way, i.e. are bottled with the same automatic machinery without modification.

SUMMARY OF THE INVENTION

In view of these practices and the disadvantages and particularly danger connected with them, it is an object of the invention to improve a screw cap of the type previously discussed in such a way that, if higher internal pressures are exceeded, the sealing effect is reliably lost. Unacceptable inner pressures are not allowed to build up. This is also intended to apply to screw caps with the sealing rings customary today, which so far have even contributed to the screw cap staying on and thus to an unacceptable build-up of pressure in closed glass bottles.

This object is attained by the invention in that at least a partial area at the transition from the end face to the thread face is not deep-drawn down to the lateral edge of the mouth, but is excepted from such deformation.

The invention is based on the realization that deep-drawing of the transition area between the upper end face and the lateral thread face certainly results in a large increase of tightness. However, the deformation customarily employed for this only permits the screw cap to act as a uniform sealing element. In contrast thereto the invention, by means of its contrasting shaping, creates a local area of relatively low resistance and thus lesser tightness which, if required, takes on the desired safety function. In view of the locally limited changes and results, it could also be said that this safety function is similar to a safety valve. Once the gas has surmounted the sealing area in the partial, not deformed area, it can escape from the screw cap without hindrance via the otherwise permeable threads as well as the sealing ring. It makes no difference at all whether or not the screw cap is equipped with a sealing ring.

As shown, the invention proposes a new shape which permits venting at a defined place without it being necessary that the entire screw cap lift off or large areas of it be deformed. The larger the size of the undeformed partial area is selected, the sooner venting can be expected. However, since as a rule not only the conditions of safe venting, but first of all of sufficient sealing must be fulfilled, the ratio of the proposed undeformed partial area to the rest of the area deformed in a known manner must be individually determined depending on glass thickness, type of contents and other criteria. Suitable values can be easily and dependably determined empirically.

It is preferable to choose a number of correspondingly shorter partial areas instead of a longer undeformed partial area. The length of the partial areas should be in the millimeter range, e.g. between 3 and 7 mm. It is also advantageous if the partial areas are disposed equally along the lateral edge of the mouth. By virtue of the means proposed it becomes possible to dependably match the somewhat opposite requirements for sufficient sealing and timely venting.

In connection with a deep-drawing device of the previously discussed type it is proposed by the invention that the third recess have at least a partial enlargement oriented towards the center axis up to approximately the diameter of the second recess. Furthermore, several enlargements should be provided and the enlargements should be evenly distributed around the center exis. Finally, an advantageous improvement is characterized in that the enlargements have, seen from above, an approximately semi-circular diameter with rounded-off outflow areas.

The proposed deep-drawing device can be readily used in place of known deep-drawing devices in the sealing heads of existing automatic bottling machines. It permits a quick and stressless production of the desired screw caps. It is understood that in the third recess a stop (abutment) can be used which can be pressed back against a spring or the like, particularly a stop provided with an additional measuring pin corresponding to the so-called safety plungers.

The invention is further described below by means of the drawings of preferred embodiments.

DETAILED DESCRIPTION OF THE PREFERRED EMBODIMENTS

Figure 1:
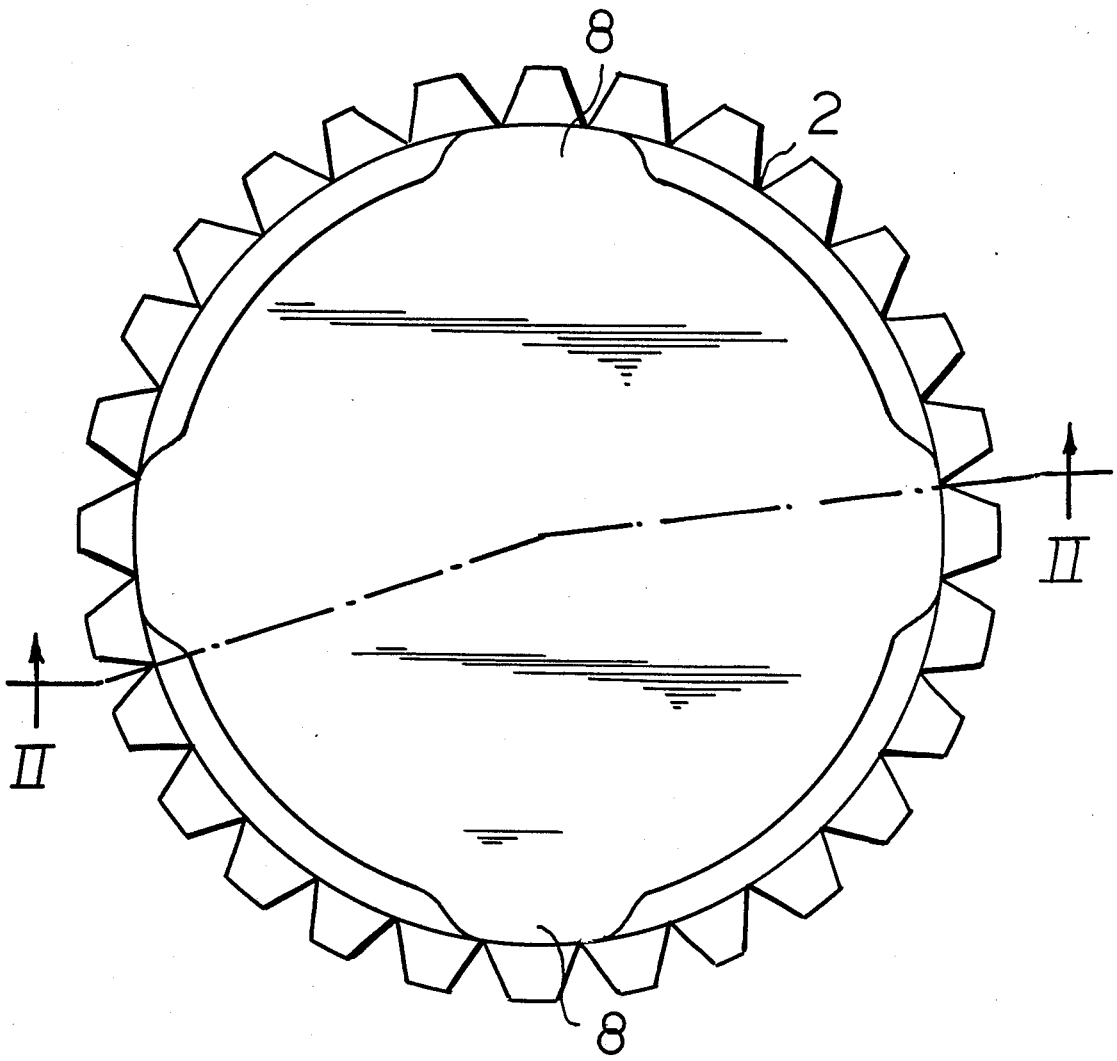
FIG. 1 is a top view of a screw cap in accordance with the invention.
Figure 2:
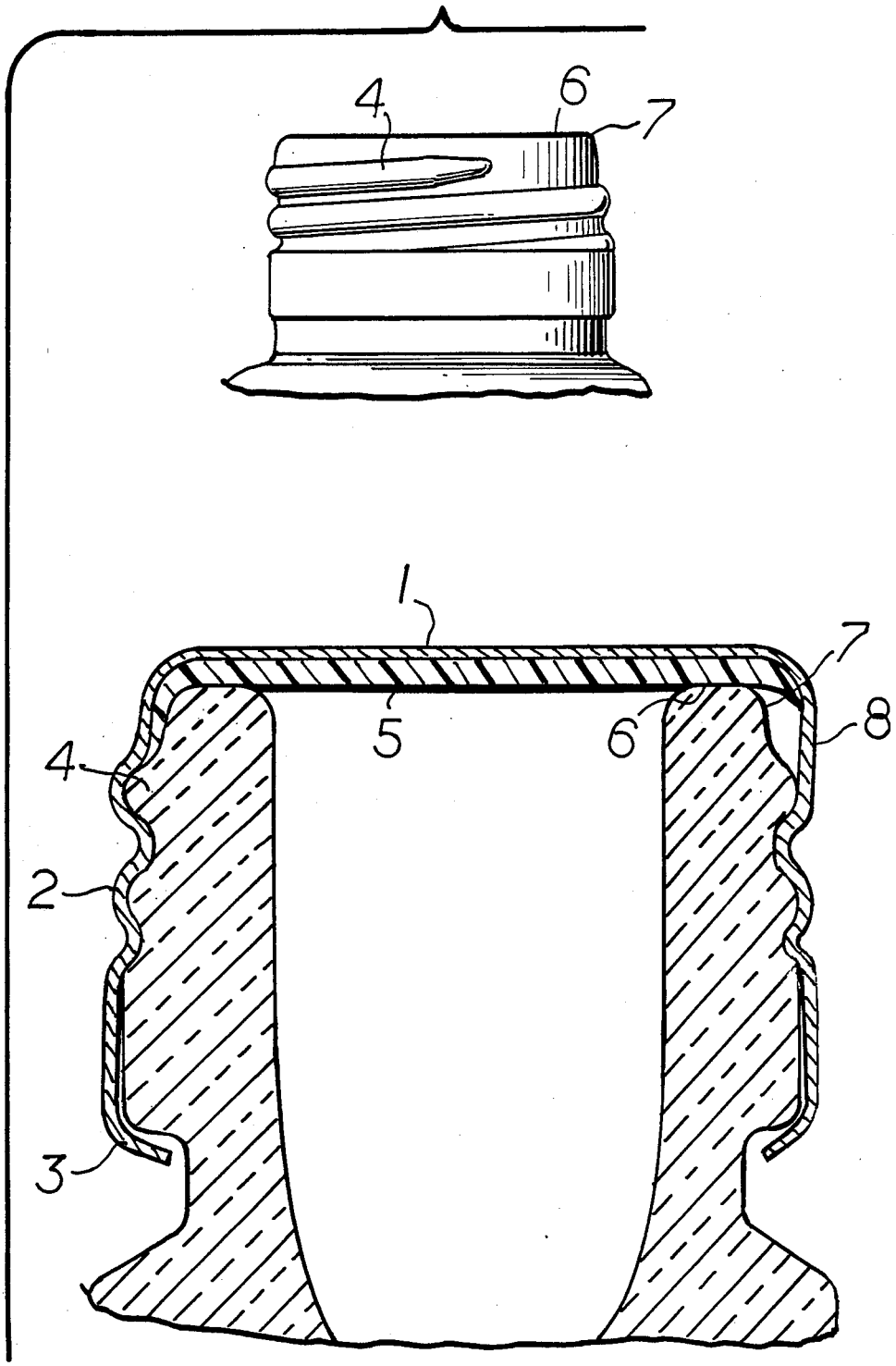
FIG. 2 is a subject of FIG. 1 without ribbing, in a sectional view along the line II—II and, inserted into it, the mouth of a glass bottle with its outer thread in a side elevational view.

In accordance with FIGS. 1 and 2, a screw cap of aluminum has an upper end face 1, a lateral thread face 2 and a sealing ring 3. The upper end face 1 is in general flat and not deformed, the lateral thread face 2 corresponds to the outer thread 4 at the mouth of the glass bottle to be closed and is formed into this shape by twisting, and the sealing ring 3 is inwardly crimped like a sort of collar. The end face 1 has a sealing material 5 such as rubber or other suitable compressible seal material on its inside, which extends as far as the inside of the thread face 2.

As shown, there is first a seal between the end face 1 and the upper edge 6 of the mouth of the glass bottle. As far as the transition area between the upper end face 1 and the thread face 2 is deep-drawn by pressure in the direction of the lateral edge 7 of the mouth of the glass bottle, there is an additional sealing effect in this area. However, this is interrupted where the partial areas 8 have not been deformed, as suggested in the invention. In the present case there are four such partial areas which are evenly distributed over the circumference of the screw cap and in actuality each measures under 1 cm in length. In accordance with the invention, gas will escape and the pressure will be reduced in one or more of these areas, should the gas pressure inside the glass bottle increase to dangerous levels. In this way uncontrolled destruction with damage to objects and especially to health can be timely counteracted.

Figure 3:
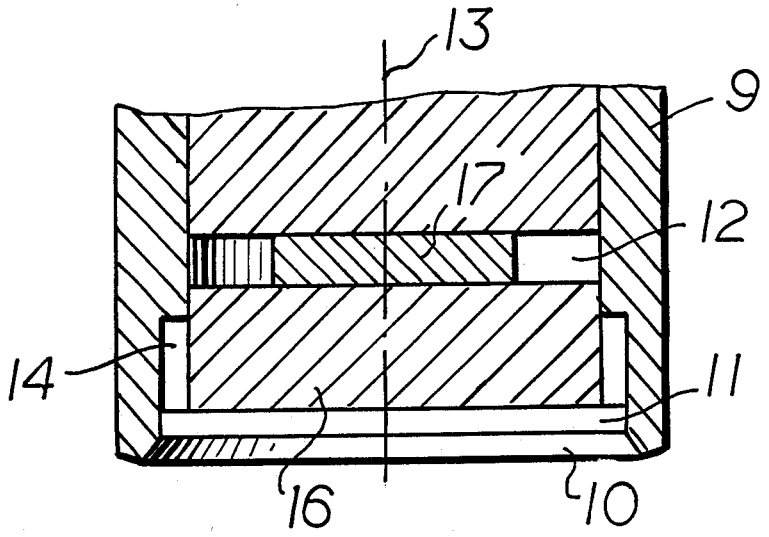
FIG. 3 is a longitudinal section of the lower part of a deep-drawing device according to the invention.
Figure 4:
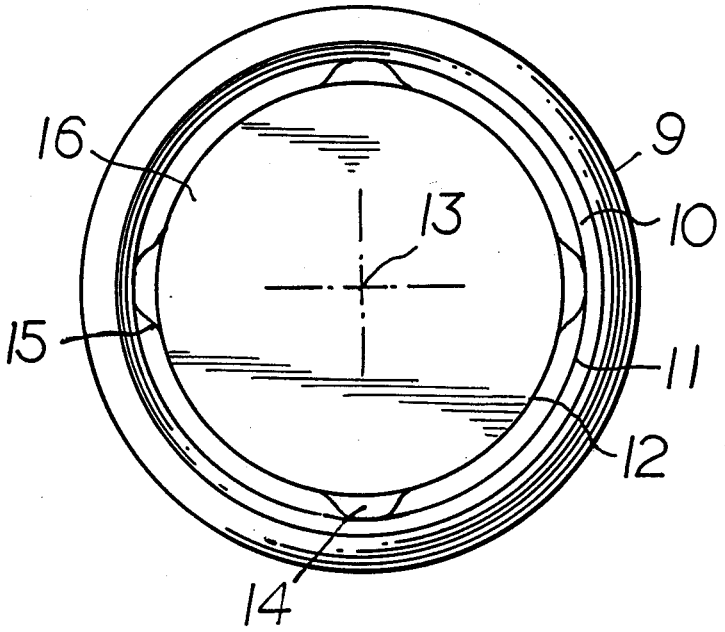
FIG. 4 is a bottom view of the subject of FIG. 3.

As further shown in FIGS. 3 and 4, a deep-drawing device comprises a matrix 9 with recesses 10, 11 and 12, which are disposed concentrically around a center axis 13 and decrease in size from the outside inward. The first recess 10 continuously tapers until reaching approximately the largest outer diameter of the screw cap to be produced. A second recess 11 with approximately even diameter immediately follows. In contrast thereto, the third recess 12 is stepped, i.e. has a smaller diameter which, however, is in general constant.

In accordance with the invention the third recess 12 has partial enlargements 14 which are oriented parallel to the center axis 13. These extend approximately to the diameter of the second recess 11. In the present exemplary embodiment, four recesses 14 are evenly distributed around the center axis 13. In top plane view they have an approximately semi-circular diameter with rounded-off outflow areas 15. Furthermore, inside the third recess 12 a stop (abutment) 16 is movably fastened which can be pressed back against the force of a compression spring into the inside of the matrix 9.

The deep-drawing device described above can be used in connection with the customary sealing heads of automatic bottling machines. It is pushed on an unfinished screw cap from above and causes deformation of the transition area between the upper end face and the lateral thread face while leaving short partial areas 8 corresponding to the enlargements 14 undeformed.

What is claimed is:

1. A deep-drawn screw cap for bottles adapted to be under internal pressure, comprising:

an upper end face defining an inside surface, a lateral thread face, a transition area between said upper end face and said lateral thread face, a sealing ring, a sealing material disposed on the inside surface of the end face, close to said transition area, to form a seal along an edge of a mouth of a bottle to which the cap is attached, said sealing material including a plurality of deformed areas which are deepdrawn toward an area adapted to mate with the mouth of the bottle, and said sealing material including at least one undeformed area at said transition area not being deep-drawn down to said area.

2. A screw cap in accordance with claim 1, wherein a plurality of said undeformed, areas which are not deep-drawn are provided for disposition about the lateral edge of the mouth of a bottle when said cap is disposed on the bottle mouth.

3. A screw cap in accordance with claim 2, characterized in that the undeformed areas are evenly disposed about the lateral edge of the mouth of the bottle when disposed thereon.

4. A screw cap as in claim 1 wherein said deformed areas extend substantially to a beginning portion of said lateral thread face.

* * * * *